US006597880B2

(12) United States Patent
Park

(10) Patent No.: US 6,597,880 B2
(45) Date of Patent: Jul. 22, 2003

(54) APPARATUS FOR PREVENTING INK IN A WET ELECTROPHOTOGRAPHIC PRINTER FROM POLLUTING A ROLLER MOUNTED THEREIN

(75) Inventor: Woo-yong Park, Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/848,502

(22) Filed: May 4, 2001

(65) Prior Publication Data

US 2002/0025182 A1 Feb. 28, 2002

(30) Foreign Application Priority Data

Aug. 23, 2000 (KR) ..... 2000-49018

(51) Int. Cl.[7] ..... G03G 15/08
(52) U.S. Cl. ..... 399/103; 399/239
(58) Field of Search ..... 399/102, 103, 399/237, 239, 233, 238; 277/320, 365, 430, 460, 465; 415/71, 77, 110, 112

(56) References Cited

U.S. PATENT DOCUMENTS 5,322,298 A * 6/1994 Maier ..... 277/430
6,210,103 B1 * 4/2001 Ramsay ..... 415/112

FOREIGN PATENT DOCUMENTS

| | | |
|---|---|---|
| JP | 3-67355 | 1/1991 |
| JP | 8-179634 | 12/1996 |
| JP | 2938003 | 11/1999 |

* cited by examiner

*Primary Examiner*—Hoan Tran
(74) *Attorney, Agent, or Firm*—Sughrue Mion, PLLC

(57) ABSTRACT

An ink pollution prevention device in a wet electrophotographic printer, for preventing a developer from polluting a photoreceptor and peripheral devices by flowing out at the ends of a development roller, a squeegee roller, and a cleaning roller, is provided with a pair of ink stoppers mounted around a shaft of each roller in a symmetrical manner with each other. Each ink stopper has a plurality of peaks and recesses which form a continuous helical shape in an opposite helical direction from the other ink stopper. The helical direction of the ink stopper is formed to permit the ink in the ink stopper to flow toward the center of the rollers when the rollers are rotated.

9 Claims, 6 Drawing Sheets

APPARATUS FOR PREVENTING INK IN A WET ELECTROPHOTOGRAPHIC PRINTER FROM POLLUTING A ROLLER MOUNTED THEREIN

BACKGROUND OF THE INVENTION

1. Field of the Invention

The present invention relates to a wet electrophotographic printer and, more particularly, to a wet electrophotographic printer capable of preventing peripheral devices such as a photoreceptor belt from being contaminated by ink which flows outwardly at both ends of a plurality of rollers after being used for a development process.

2. Description of the Related Art

In general, a wet electrophotographic printer emits a laser beam onto a photoreceptor such as a photoreceptor belt to generate an electrostatic latent image, develops the electrostatic latent image by using a developer liquid which is normally mixed with a toner in a solid state having a predetermined color, and a carrier in a liquid state functioning as a solvent, and produces a desired image on a paper through transcription.

In FIG. 1, there are shown major components of a wet electrophotographic printer as described above. A photoreceptor belt 1 is trained over rollers 2, 3, and 4 mounted within a main body of the printer (not shown), to run or circulate therearound. An electostatic latent image is formed on the photoreceptor belt 1 by a beam exposing device (not shown), and then is developed by a developing device 10. An image formed on the photoreceptor belt 1 by the developing device 10 is dried by a drier 20, up to a level required for transcription, and finally is transcribed in a transcriber 30 onto a paper supplied from the outside.

The developing device 10 is provided with a plurality of development units (normally four), each of which corresponds to a color. Representative of other development units, development unit 11 includes a development roller 13 for transcribing a developer injected from a developer injection nozzle 12 onto a region of the electrostatic latent image on the photoreceptor belt 1, and a squeegee roller 14 for removing the carrier from the developer transcribed onto the photoreceptor belt 1. Although not shown in the drawings, a cleaning roller for removing sludge of the developer smeared around the squeegee roller 14 is provided in the developing device 10.

When the electrostatic latent image of the photoreceptor belt 1 arrives at the development roller 13, the toner contained in the developer is moved to the region of the electrostatic latent image on the photoreceptor belt 1 to adhere thereto, due to an electric potential difference between the region of the electrostatic latent image and the development roller 13. Since a portion of the photoreceptor belt 1 unexposed to the beam has a higher electric potential than that of the development roller, the developer is smeared on the belt 1 rather than the toner. The electrostatic latent image is filmed over with a portion of the toner adhering to the electrostatic latent image by the squeegee roller 14 depressing the photoreceptor belt 1, and the developer with the rest of the toner is removed by the squeegee roller 14.

The development is performed in such a manner so that the development roller 13 and the squeegee roller 14, both in close contact to the photoreceptor belt 1, depress the photoreceptor belt 1, thereby spreading the developer over the rollers 13, 14. Consequently, the remaining developer not used for the development process is driven or pushed out toward both ends of the rollers 13, 14. The rollers 13, 14 may be contaminated with the remaining ink, i.e., the ink pushed out which pollutes the peripheral devices including the photoreceptor belt 1.

In FIGS. 2 through 5, a conventional ink contamination prevention device for preventing the contamination by the remaining ink described above is shown. The conventional ink contamination prevention device is provided with a pair of protrusions 40, 40' for stopping a flow of the ink toward both ends of the development roller 13.

As shown in FIG. 4, the ink contamination prevention device constructed in this manner can prevent the remaining ink 100 from flowing to the outside of the development roller 13, since the protrusions 40, 40' stop the flow of the remaining ink 100.

However, as shown in FIG. 5, since the protrusions for stopping the flow of the remaining ink are formed in a simple annular shape around a shaft of the development roller 13 in the conventional ink contamination prevention device, when the development roller 13 rotates, there is a possibility of the remaining ink 100 accommodated in recesses defined by the protrusions 40, 40', flowing to the outside of the development roller 13 beyond the protrusions 40, 40'. That is, stopping the flow of the remaining ink 100 is not fully achieved, thereby polluting the roller and the peripheral devices and degrading the lifetime of those components. Further, if the contamination by the remaining ink described above occurs in the squeegee roller 14, the remaining ink may flow from an end of the squeegee roller 14 to the photoreceptor belt 1 to pollute the same, causing a degradation of the quality of the print.

SUMMARY OF THE INVENTION

It is, therefore, a primary object of the invention to provide an ink pollution prevention device capable of preventing remaining ink from polluting rollers, peripheral devices, and a photoreceptor such as a photoreceptor belt by fully stopping a flow of the remaining ink toward the outside of a roller at both ends of the roller.

In order to achieve the object, the present invention provides an ink pollution prevention device in a wet electrophotographic printer, for preventing a developer from polluting a photoreceptor and peripheral devices by flowing out at the ends of a development roller, a squeegee roller, and a cleaning roller to the outside of the rollers. The device is provided with a pair of ink stoppers, with stoppers disposed around both sides of a shaft of each roller in a symmetrical manner with each other. Each ink stopper has a plurality of peaks and recesses which form a continuous helical shape in an opposite helical direction from the other ink stopper. The helical shape of the ink stopper is oriented so as to permit the ink in the ink stopper to flow toward the center of the roller along the recesses, when the roller is rotated.

The ink stopper can be integrally formed with a shaft of each roller or independently formed and mounted on the shaft, as a fixed member.

BRIEF DESCRIPTION OF THE DRAWINGS

The above and other objects and features of the present invention will become apparent by the following description of the preferred embodiments taken in conjunction with the accompanying drawings, in which.

DETAILED DESCRIPTION OF THE PREFERRED EMBODIMENTS

A preferred embodiment of an ink pollution prevention device is described with reference to accompanying drawings.

Figure 10:
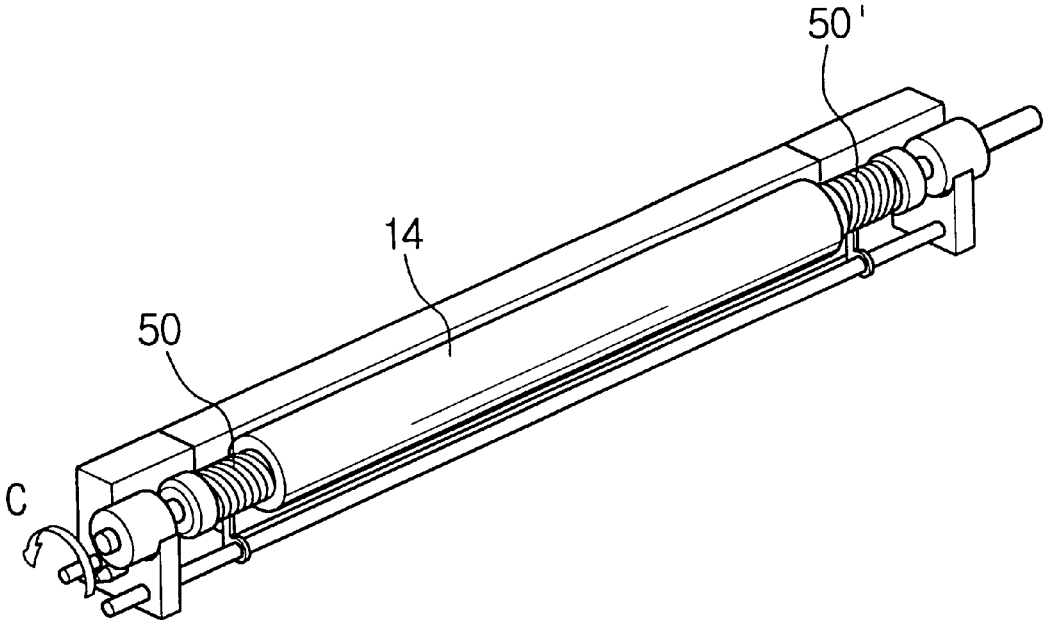
FIG. 10 describes a perspective view of the ink pollution prevention device applied to a squeegee roller according to the present invention.
Figure 11:
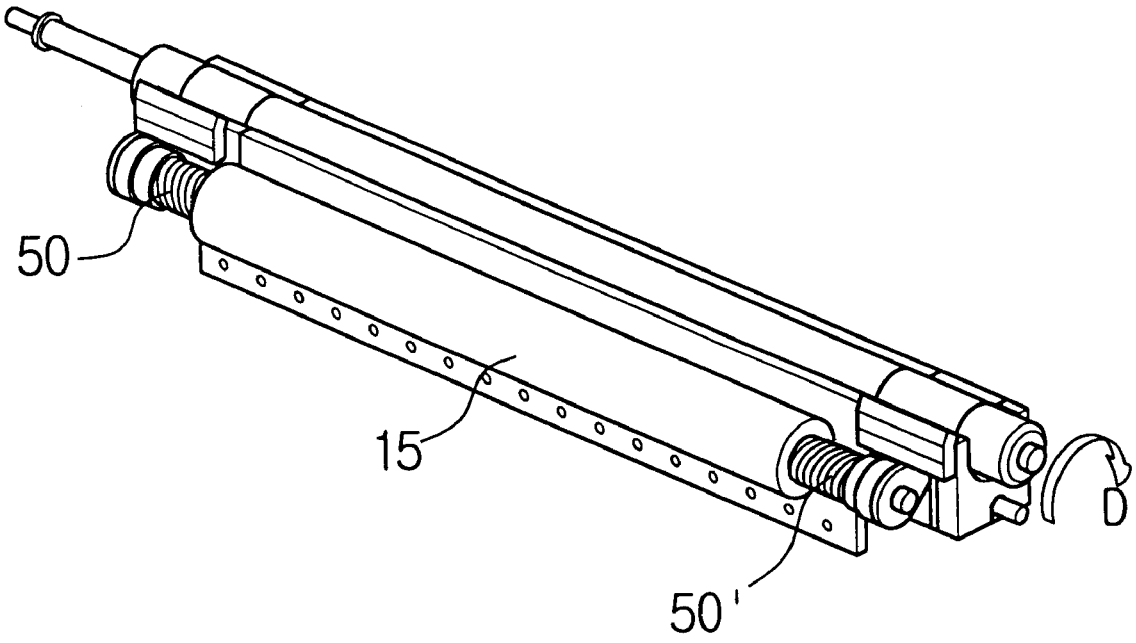
FIG. 11 represents a perspective view of the ink pollution prevention device applied to a cleaning roller according to the present invention.

FIGS. 6 through 9 show an ink pollution prevention device applied to a development roller according to the present invention. FIG. 10 shows the ink pollution prevention device applied to a squeegee roller, and FIG. 11 shows the ink pollution prevention device applied to a cleaning roller according to the present invention, respectively.

Figure 6:
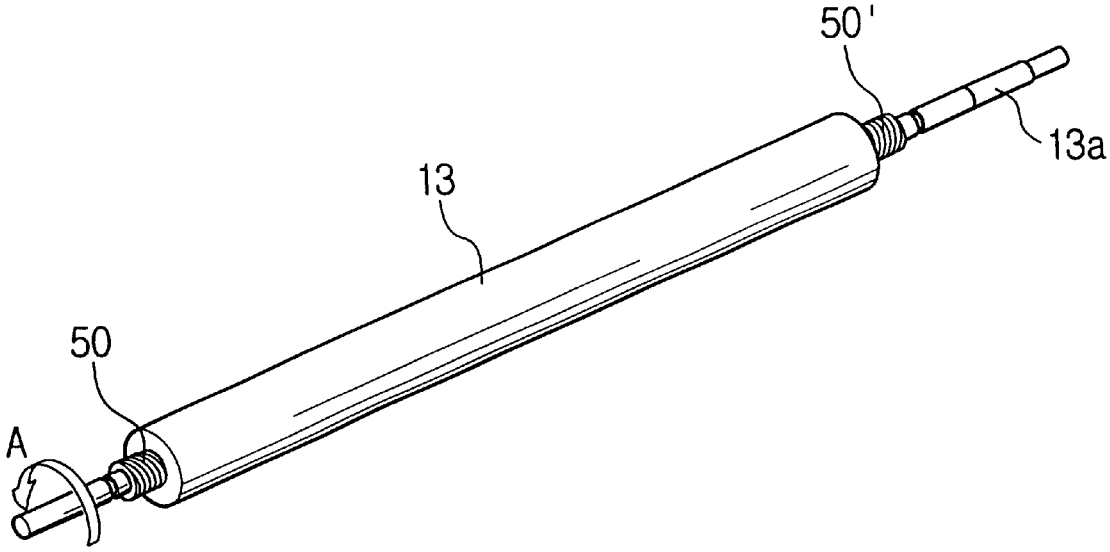
FIG. 6 discloses a perspective view of a development roller equipped with an ink pollution prevention device according to the present invention.

As shown in FIG. 6, the ink pollution prevention device according to the present invention comprises a pair of ink stoppers 50, 50', with stoppers formed in a symmetrical manner to each other around a shaft 13*a* of the development roller 13, which serve to prevent remaining ink not being used in a development process, from flowing out toward the outside of the roller 13 at both ends of the roller 13.

Figure 7:
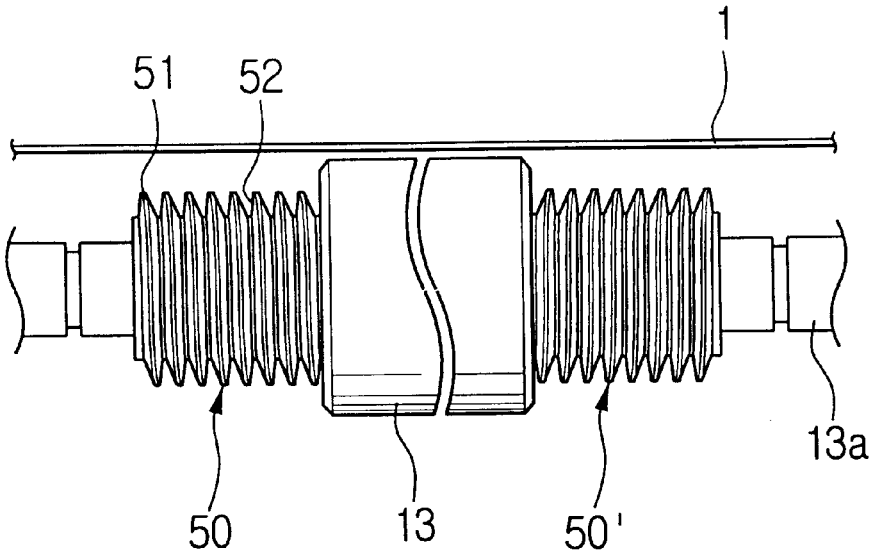
FIG. 7 shows an enlarged view of the ink pollution prevention device provided in the development roller shown in FIG. 6.

As shown in FIG. 7, each of the ink stoppers 50, 50' is formed with a plurality of peaks and recesses which are in a continuous helical form. The peak 51 serves to stop the flow of the remaining ink, whereas the recess 52 guides the flow of the remaining ink.

The helical ink stoppers 50, 50' may be integrally formed on the shaft 13*a* or formed as a separate member to be mounted on the shaft 13*a* by a fixing member (not shown). Further, the size or dimension of the ink stoppers 50, 50' is not limited. It is preferable that five through ten peaks should be formed depending upon the construction of the roller.

Figure 1:
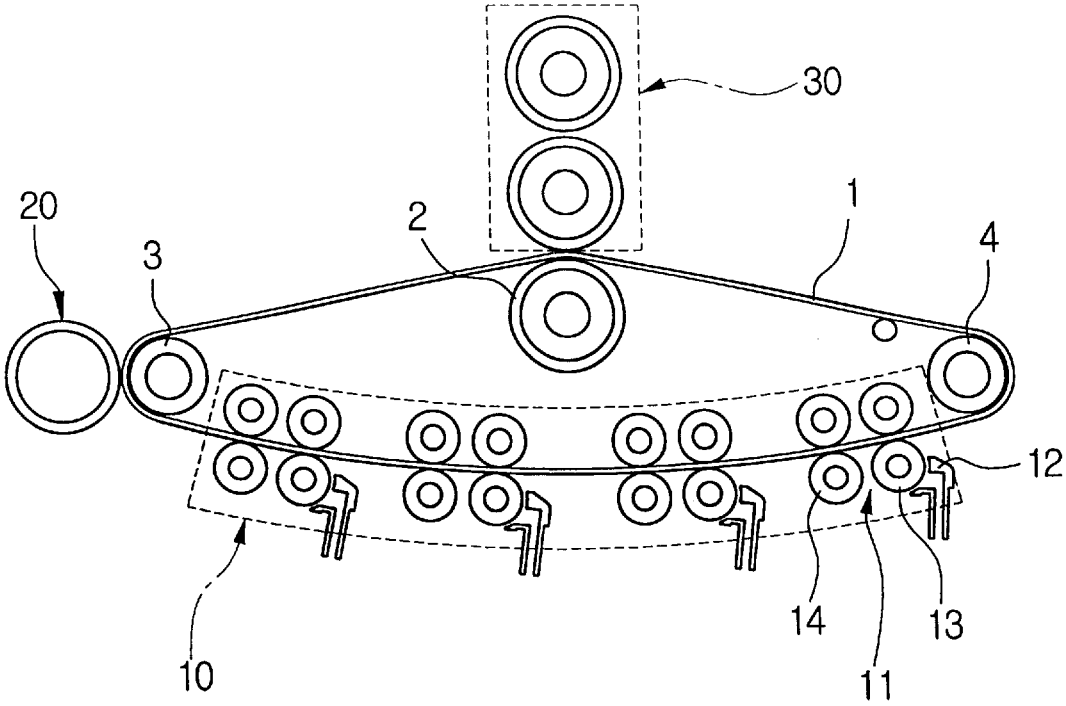
FIG. 1 PRIOR ART
FIG. 1 illustrates a schematic view of a conventional development device in a wet electrophotographic printer.
Figure 2:
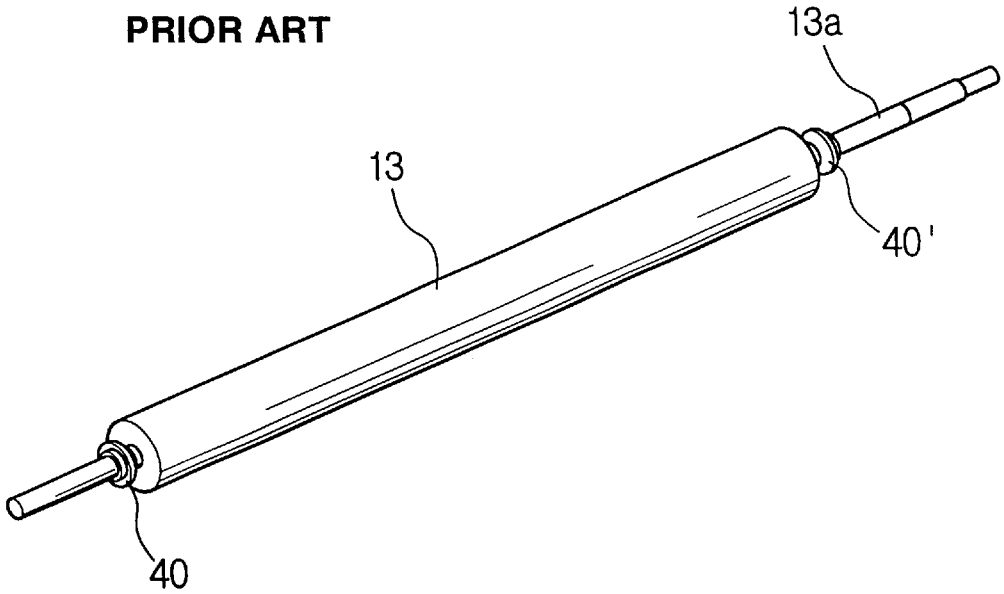
FIG. 2 PRIOR ART
FIG. 2 shows a perspective view of a conventional development roller equipped with a conventional ink contamination prevention device.
Figure 3:
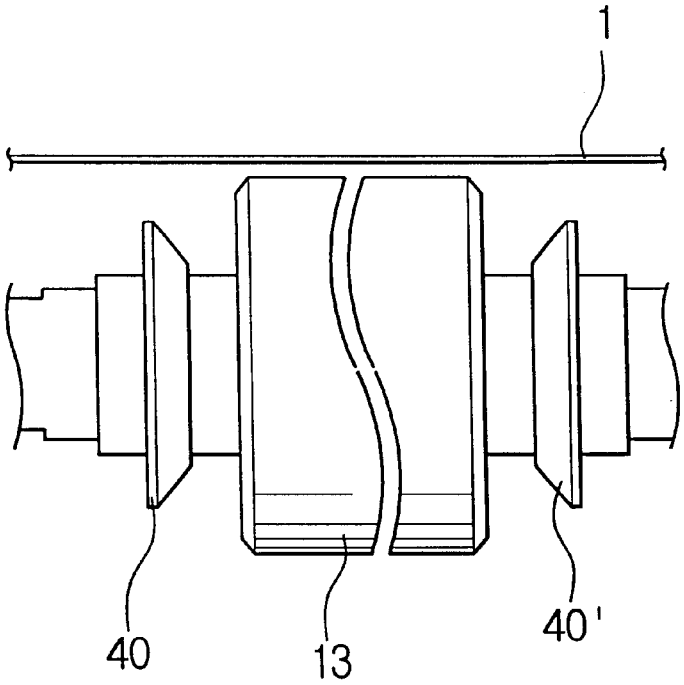
FIG.3 PRIOR ART
FIG. 3 depicts an enlarged view of the ink contamination prevention device provided in the development roller shown in FIG. 2.
Figure 4:
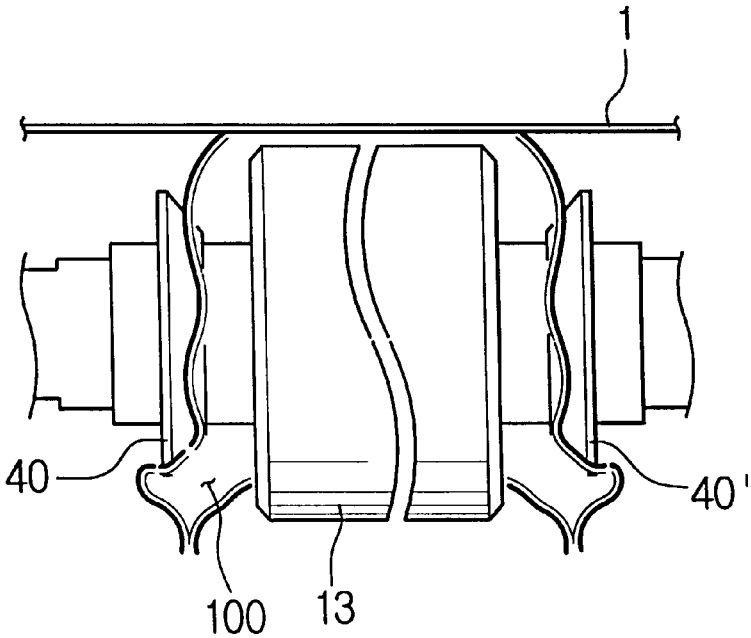
FIG.4 PRIOR ART
FIG. 4 presents an enlarged view showing a flow of a remaining ink at both ends of the development roller shown in FIG. 2.
Figure 5:
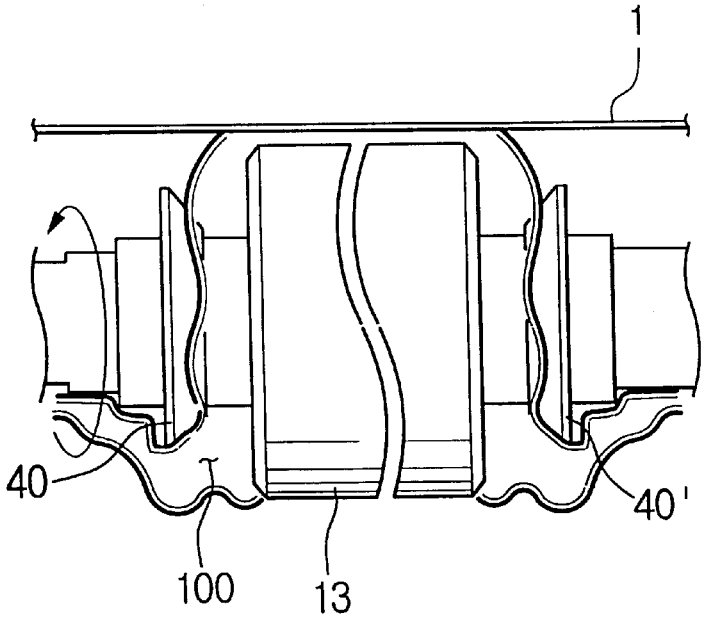
FIG.5 PRIOR ART
FIG. 5 describes an enlarged view showing the flow of the remaining ink at both ends of the development roller shown in FIG. 2, when the roller is rotated.

On the other hand, a helical direction of the ink stopper 50, 50' is determined by the direction of the rotation of the roller 13. That is, the helical direction is constructed in such a way so that when the roller 13 is rotated, the remaining ink accommodated in the helical recesses flow toward the center of the roller 13 along the recesses. FIG. 1 is a front side view of the rollers. Since the development roller 13 is rotated in a direction indicated with an arrow A in FIG. 6 in this embodiment, the front-sided ink stopper 50 is a right-handed helical, while the rear-sided ink stopper 50' is a left-handed helical.

Further, since the squeegee roller 14 shown in FIG. 10 is adapted to rotate in the same direction as that of the development roller 13 shown in FIG. 6, a front-sided ink stopper 50 is a right-handed helical, while a rear-sided ink stopper 50' is a left-handed helical.

On the other hand, unlike the development roller 13 or the squeegee roller 14, the cleaning roller 15 as shown in FIG. 11 is rotated in a direction indicated with an arrow D, and thus, the front-sided ink stopper 50' is a left-handed helical, while the rear-sided ink stopper 50 is a right-handed helical.

The operation of the ink pollution prevention device according to the present invention will be described hereinafter.

The operations of the development roller 13, the squeegee roller 14, and the cleaning roller 15, are basically identical to that of components in a conventional printer.

The development roller 13 and the squeegee roller 14 retaining the photoreceptor belt 1 are rotated, depressing the photoreceptor belt 1 in a close contact relationship, thereby spreading the developer on a whole surface of the photoreceptor belt 1 to remove the developer remaining outside the region of the electrostatic latent image. At that time, as described in the Description of the Related Art, the remaining ink 100 not being used in the development process is pushed out or moved toward the outside of the rollers 13, 14.

Figure 8:
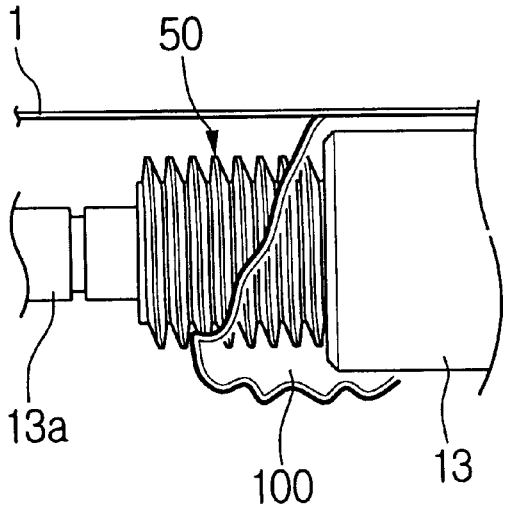
FIG. 8 depicts an enlarged view of the ink contamination prevention device provided in the development roller shown in FIG. 6.

However, as shown in FIG. 8, such remaining ink being pushed out toward the outside of the rollers does not flow outwardly, since the pair of ink stoppers 50, 50' are mounted on the rollers 13, 14.

Figure 9:
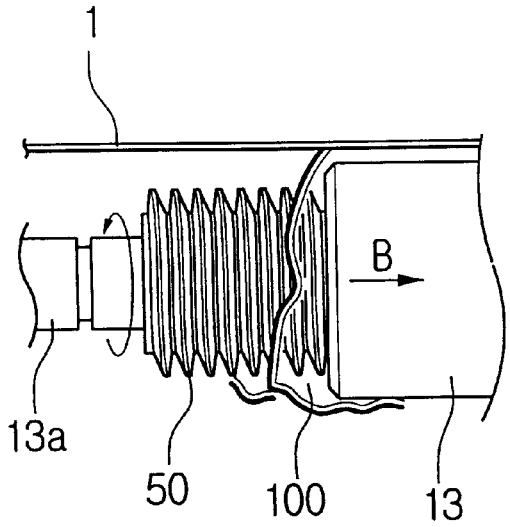
FIG. 9 presents an enlarged view showing a flow of a remaining ink at both ends of the development roller shown in FIG. 6, when the roller is rotated.

Further, since the helical direction of the ink stoppers 50, 50' is formed to permit the ink to be driven to the center of the rollers when the rollers 13, 14 are rotated, the ink 100 accommodated in the ink stoppers 50, 50' is pushed out toward the center of the rollers 13, 14, in a direction indicated with an arrow B, along the helical recesses, as shown in FIG. 9.

As described above, the helical ink stoppers 50, 50' can push out the ink toward the center of the roller 13, even if the remaining ink continues to exist or continues to be supplied. Consequently, since the remaining ink does not flow to the outside of the roller 13, the contamination of the roller 13 by the remaining ink or the contamination of the photoreceptor belt 1 and peripheral devices due to a drop of the ink can be prevented.

Further, the pair of ink stoppers 50, 50' applied to the cleaning roller 15 as shown in FIG. 11, also performs the same function as described above. Consequently, the contamination of the peripheral devices due to the remaining ink flowing toward the outside of the roller 15 can be prevented.

On the other hand, although the present invention has been described with respect to the development roller 13, the squeegee roller 14, and the cleaning roller 15 in this embodiment, rollers which are used in the wet electrophotographic printer, the present invention can be applied to other devices as well, devices in which liquid is moved to another object by using a cylindrical roller, thereby efficiently preventing a contamination caused by unwanted movement of the liquid smeared on the roller. Also, although the present invention has been described with respect to the photoreceptor belt 1 as an example of a photoreceptor in this embodiment, the present invention can be applied to the wet electrophotographic printer that uses a photoreceptor drum instead of the photoreceptor belt 1.

The present invention constructed in this manner can stop the flow of the remaining ink at the ends of the development roller 13, the squeegee roller 14, and the cleaning roller 15, by mounting a pair of ink stoppers 50, 50' on the rollers 13, 14, 15. Further, since the helical direction of the ink stopper is formed to permit the ink to be driven toward the center of the roller when the roller is rotated, the ink accommodated in the ink stopper is pushed out toward the center of the roller along the helical recesses. Accordingly, the contamination of the rollers 13, 14, 15 the photoreceptor belt 1, and other peripheral devices, which occurs when the remaining ink flows to the outside of the rollers at both ends of the rollers, can be inherently prevented. As a result, the peripheral device can maintain a proper lifetime and a quality of the print can be enhanced.

Although the invention has been shown and described with respect to the preferred embodiments, it will be understood by those skilled in the art that various changes and modifications may be made without departing from the spirit and scope of the invention as defined in the following claims.

What is claimed is:

1. An ink pollution prevention device in a wet electrophotographic printer, for preventing a developer from polluting a photoreceptor and peripheral devices by flowing out at the ends of a development roller, a squeegee roller and a cleaning roller, the device comprising:

a pair of ink stoppers, wherein each stopper is disposed at one of two sides of a shaft of each roller, in a symmetrical manner with each other, each stopper having a plurality of peaks and recesses which form a continuous helical shape in an opposite helical direction from the other ink stopper.

2. The device as claimed in claim 1, wherein the helical direction of the ink stopper is formed to permit the ink in the ink stopper to flow toward the center of the rollers along the recesses when the rollers are rotated.

3. The device as claimed in claim 1, wherein the ink stoppers are integrally formed with the shaft of each roller.

4. The device as claimed in claim 1, wherein the ink stoppers are independently formed and mounted on the shaft of each roller.

5. The device as claimed in claim 1, wherein at least one of said stoppers has a non-tapered shape.

6. An apparatus for use in devices in which a liquid is moved to another object by using a cylindrical roller, for preventing a contamination caused by an unwanted movement of the liquid smeared on the roller, the apparatus comprising:

a pair of stoppers, wherein each stopper is disposed at one of two sides of the roller, in a symmetrical manner with each other, each stopper having a plurality of peaks and recesses which form a continuous helical shape in an opposite helical direction from the other stopper.

7. The apparatus as claimed in claim 6, wherein at least one of said stoppers has a non-tapered shape.

8. A pair of stoppers disposed at one of two sides of a roller, in a symmetrical manner with each other, each stopper having a plurality of peaks and recesses which form a continuous helical shape in an opposite helical direction from the other stopper to permit a liquid in the stopper to flow toward a center of the roller along the recesses when the roller is rotated.

9. The pair of stoppers as claimed in claim 8, wherein at least one of said stoppers has a non-tapered shape.

* * * * *